US005750320A

United States Patent [19]

Bogdanowicz et al.

[11] Patent Number: 5,750,320

[45] Date of Patent: May 12, 1998

[54] COLOR MOTION PICTURE PRINT FILMS FOR TELECINE TRANSFER APPLICATIONS

[75] Inventors: Mitchell Joseph Bogdanowicz, Spencerport; Charles Peter Hagmaier; Leslie Gutierrez, both of Rochester, all of N.Y.

[73] Assignee: Eastman Kodak Company, Rochester, N.Y.

[21] Appl. No.: 602,434

[22] Filed: Feb. 16, 1996

[51] Int. Cl.[6] ..... G03C 7/46

[52] U.S. Cl. ..... 430/383; 430/359; 430/21; 430/503; 430/505; 430/502; 430/504; 430/506; 430/508; 430/509

[58] Field of Search ..... 430/502, 504, 430/506, 508, 509, 505, 503, 359, 383, 21

[56] References Cited

U.S. PATENT DOCUMENTS

| | | | |
|---|---|---|---|
| 3,740,457 | 6/1973 | Meeussen et al. | 178/5.4 CD |
| 3,849,138 | 11/1974 | Wyckoff | 96/74 |
| 4,161,406 | 7/1979 | Bulloch | 96/55 |
| 4,680,253 | 7/1987 | Shibahara et al. | 430/504 |
| 4,792,518 | 12/1988 | Kuwashima et al. | 430/505 |
| 4,855,836 | 8/1989 | Shearer | 358/214 |
| 4,994,355 | 2/1991 | Dickerson et al. | 430/509 |
| 5,003,379 | 3/1991 | Moore, Jr. et al. | 358/54 |
| 5,108,881 | 4/1992 | Dickerson et al. | 430/502 |
| 5,266,451 | 11/1993 | Schmuck et al. | 430/509 |
| 5,268,251 | 12/1993 | Sakuma | 430/139 |
| 5,300,381 | 4/1994 | Buhr et al. | 430/30 |
| 5,314,793 | 5/1994 | Chang et al. | 430/506 |
| 5,360,703 | 11/1994 | Chang et al. | 430/506 |
| 5,390,036 | 2/1995 | Buhr et al. | 358/519 |
| 5,391,443 | 2/1995 | Simons et al. | 430/21 |
| 5,428,387 | 6/1995 | Galt et al. | 348/97 |
| 5,500,316 | 3/1996 | Bogdanowicz et al. | 430/21 |
| 5,561,012 | 10/1996 | Brewer et al. | 430/21 |
| 5,576,128 | 11/1996 | Keech et al. | 430/21 |
| 5,674,665 | 10/1997 | Sawyer et al. | 430/383 |

FOREIGN PATENT DOCUMENTS

| | | |
|---|---|---|
| 324471 | 7/1989 | European Pat. Off. . |
| 684511 | 11/1995 | European Pat. Off. . |
| 1912222 | 10/1969 | Germany . |

OTHER PUBLICATIONS

*The Negative* by Ansel Adams, New York Graphic Society, Boston, MA USA (1981), Chapter 4, "The Zone System", pp. 47–98.

*Engineering Handbook;* Edward Ebfitts, Ed., 8th ed., National Association of Broadcasters, 1992, Ch. 5–8, pp. 933–946, "Film For Television" by Richard W. Bauer.

Paul Collard, "The Film/Tape Interface", Image Technology, May 1988, pp. 149–154.

*Primary Examiner*—Geraldine Letscher
*Attorney, Agent, or Firm*—Andrew J. Anderson

[57] ABSTRACT

Silver halide light sensitive photographic print elements are disclosed comprising a support bearing on one side thereof: a blue color sensitive record comprising at least one blue-sensitive silver halide emulsion yellow-image forming layer, a red color sensitive record comprising at least one red-sensitive silver halide emulsion cyan-image forming layer, and a green color sensitive record comprising at least one green-sensitive silver halide emulsion magenta-image forming layer; wherein at least one of the color records has a fixed best fit contrast less than or equal to 2.2, wherein the fixed best fit contrast for a color record is defined as the slope of a straight line connecting a point B and a point C on the characteristic curve of Status A density versus log Exposure for the color record, where points B and C are located by defining a point A on the characteristic curve at the log Exposure required to attain a density level of 1.0, and points B and C are located on the characteristic curve at exposure values −0.40 log Exposure and +0.65 log Exposure with respect to point A, respectively. In preferred embodiments, the fixed best fit contrast (FBFC) values of at least two color records and most preferably of each of the blue, red, and green color records are less than 2.2. Such FBFC values are below the typical contrast limitations of conventional color print films designed for direct projection viewing, and enable the production of especially pleasing images in telecine transfers compared to print elements with higher FBFC values.

23 Claims, 2 Drawing Sheets

COLOR MOTION PICTURE PRINT FILMS FOR TELECINE TRANSFER APPLICATIONS

FIELD OF THE INVENTION

The invention relates to a color motion picture print film, and more particularly to such a film which has contrast adjusted for optimized electronic scanning with a telecine transfer device.

BACKGROUND

Color negative films are a class of photosensitive materials that map the luminance (neutral) and chrominance (color) information of a scene to complementary tonal and hue polarities in the negative film. Light areas of the scene are recorded as dark areas on the color negative film, and dark areas of the scene are recorded as light areas on the color negative film. Colored areas of the scene are recorded as complementary colors in the color negative film: red is recorded as cyan, green is recorded as magenta, blue is recorded as yellow, etc. In order to render an accurate reproduction of a scene, a subsequent process is necessary to reverse the luminance and chrominance information back to those of the original scene. This subsequent process may or may not require another photosensitive material.

In the motion picture industry, there are two common subsequent processes. One such subsequent process is to optically print (by contact or optics) the color negative film onto another negative working photosensitive material, such as Eastman Color Print Film 5386™, to produce a color positive image suitable for projection. Photographic print films typically use relatively small grain, high chloride emulsions (e.g., emulsions having average grain size equivalent circular diameters of less than about 1 micron and halide contents of greater than 50 mole % chloride) in order to optimize print image quality and enable rapid processing. Such emulsions typically result in relatively low speed photographic elements in comparison to camera negative films. Low speed is compensated for by the use of relatively high intensity print lamps or lasers for exposing such print elements. For comparison purposes, it is noted that motion picture color print films, e.g., when rated using the same international standards criteria used for rating camera negative films, would typically have an ISO speed rating of less than 10, which is several stops slower than the slowest camera negative films in current use.

Another subsequent process in the motion picture industry is to transfer the color negative film information directly into a video signal using a telecine transfer device, or indirectly by first making a positive photographic print and then transferring the print film information into a video signal using such a device. Various types of telecine transfer devices are described in *Engineering Handbook*, E. O. Fritts, Ed., 8th edition, National Association of Broadcasters, 1992, Chapter 5.8, pp. 933–946, the disclosure of which is incorporated by reference. The most popular of such devices generally employ either a flying spot scanner using photomultiplier tube detectors, or arrays of charged-coupled devices, also called CCD sensors. Telecine devices scan each negative or positive film frame transforming the transmittance at each pixel of an image into voltage. The signal processing then inverts the electrical signal in the case of a transfer made from a negative film in order to render a positive image. The signal is carefully amplified and modulated, and fed into a cathode ray tube monitor to display the image reproduction, or recorded onto magnetic tape for storage.

In the motion picture industry, the same color negative films and color print films are typically used for both optical printing and making telecine transfers to a video signal. In order to obtain a high quality visual image in an optical print, the contrasts for each color record of the negative film and print film are conventionally maintained above minimum levels (e.g., mid-scale contrasts equal to or above 0.45 for negative films and equal to or above 2.5 for print films) in order to avoid production of flat-looking positive print images with black tones rendered as smokey-grey and white tones rendered as light gray, as pictures such as these would not be pleasing to view and would be deemed to be of low quality in the industry.

Images captured in a conventional color negative film having such contrasts designed for optical printing, however, can exhibit a loss of detail in highlights of high dynamic range scenes upon being processed with a telecine transfer device. Loss in highlight detail in a telecine transfer is commonly caused by "burn-out" (high densities of a color negative film mapped to higher voltages than can be displayed on cathode ray monitors). Excessive "burn-out" makes film-to-video transfers difficult and time consuming. Also, the color negative film generally must have its three component record contrasts (i.e., red, green, and blue record contrasts) nearly equal such that the negative optically prints to a neutral on a print material. Such optically matched contrasts may result in increased cross-channel contamination in a telecine transfer where the telecine transfer device peak responses do not match the dye peak densities of the negative film color records.

Copending, commonly assigned U.S. patent applications Ser. Nos. 08/350,203 and 08/349,238, both filed Dec. 5, 1994, the disclosures of which are incorporated by reference herein, disclose color negative films which address such problems for telecine transfers made directly from color negative films. However, it is not always practical to perform telecine transfers from an original negative, as the original negative is very valuable and the number of handling steps involving such negative is desirably minimized. As such, it is common to make numerous positive prints from a negative on a print film element for distribution throughout the world, where telecine transfers are then locally made from the positive prints.

As with color negative films, some of the characteristics of a color print film designed for optical printing and projection viewing can also result in relatively low quality telecine transfers or make the transfer process difficult and time-consuming. These characteristics include the requirement that the print film contrast must be sufficiently high to achieve high densities in the shadow areas such that the observer accepts the perception of a good black. The relatively high contrast required for such desired optical print properties results in a relatively large difference in density between the shadow areas and the highlight areas in a scene, which density difference is difficult to handle on a telecine device. Images captured in a conventional color print film having such contrasts designed for optical printing accordingly can exhibit a loss of detail in shadow regions of high dynamic range scenes upon being processed with a telecine transfer device. Loss in shadow detail in a telecine transfer is commonly caused by "blocking-in" (indiscrimination of higher density blacks at the zero voltage level). Color print films designed for projection viewing also generally must have their three component record contrasts (i.e., red, green, and blue record contrasts) designed such that the tone scale of a projected image of the print is neutral to the observer with typical projection light sources. Similarly as with transfers made from negative films, such optically matched contrasts in a print film may result in increased cross-channel contamination in a telecine transfer where the telecine transfer device peak responses do not match the dye peak densities of the print film.

While color print films have previously been designed with reduced upper scale contrast in order to make shadows lighter for reproduction by a telecine's limited sensitivity to lessen blocking-in (e.g., EASTMAN™ Color LC Print Films 5380 and 5385), the overall contrast of such films are only minimally lower than standard print film contrasts (e.g., EASTMAN™ Color Print Film 5386) so as to retain the ability to be projected with reasonable quality. To further improve telecine transfer quality, such prior art films have in practice been printed very light to decrease the shadow density even further. As a result, the highlight tone scale is undesirably compressed, and pastel colors are weak and skin tone modeling is harsh. Further, as it is common for esthetic reasons to lighten or darken a scene when making a print, significant changes in shadow reproduction on the print can result in scene to scene print density variability, which may introduce further operational difficulties in making a telecine transfer. It would be desirable to provide a color print film element which would provide improved telecine transfer performance without such disadvantages.

SUMMARY OF THE INVENTION

One embodiment of the invention comprises a silver halide light sensitive photographic print element comprising a support bearing on one side thereof: a blue color sensitive record comprising at least one blue-sensitive silver halide emulsion yellow-image forming layer, a red color sensitive record comprising at least one red-sensitive silver halide emulsion cyan-image forming layer, and a green color sensitive record comprising at least one green-sensitive silver halide emulsion magenta-image forming layer; wherein at least one of the color records has a fixed best fit contrast less than or equal to 2.2, wherein the fixed best fit contrast for a color record is defined as the slope of a straight line connecting a point B and a point C on the characteristic curve of Status A density versus log Exposure for the color record, where points B and C are located by defining a point A on the characteristic curve at the log Exposure required to attain a density level of 1.0, and points B and C are located on the characteristic curve at exposure values −0.40 log Exposure and +0.65 log Exposure with respect to point A, respectively. In preferred embodiments, the fixed best fit contrast (FBFC) values of at least two color records and most preferably of each of the blue, red, and green color records are less than 2.2.

A further embodiment of the invention comprises a process of forming a telecine transfer image comprising exposing a print element as described in the above embodiments, processing the exposed element to form a developed image, and converting the developed image into video signals representative of the developed image with a telecine transfer device, wherein the contrast of the video signals representative of the color records of the image having a fixed best fit contrast less than or equal to 2.2 are raised in the telecine transfer device.

ADVANTAGES

We have found that color print film elements with fixed best fit contrast (FBFC) values below the typical contrast limitations of conventional color print films designed for direct projection viewing can be used in a telecine device and show benefits not available with such conventional films. We have found that color print films with FBFC values of at least one color record less than 2.2, more preferably less than or equal to 2.0, enable the production of especially pleasing images in telecine transfers compared to print elements with higher FBFC values. These films with low FBFC values have unexpected benefits, including improved reproduction of shadows in telecine transfer applications. Additionally, films with low FBFC values may have additional benefits resulting from the formulation changes used to achieve the low FBFC values. These benefits include higher color saturation, more accurate color hue, higher sharpness, and reduced granularity.

DETAILED DESCRIPTION OF THE INVENTION

Figure 1:
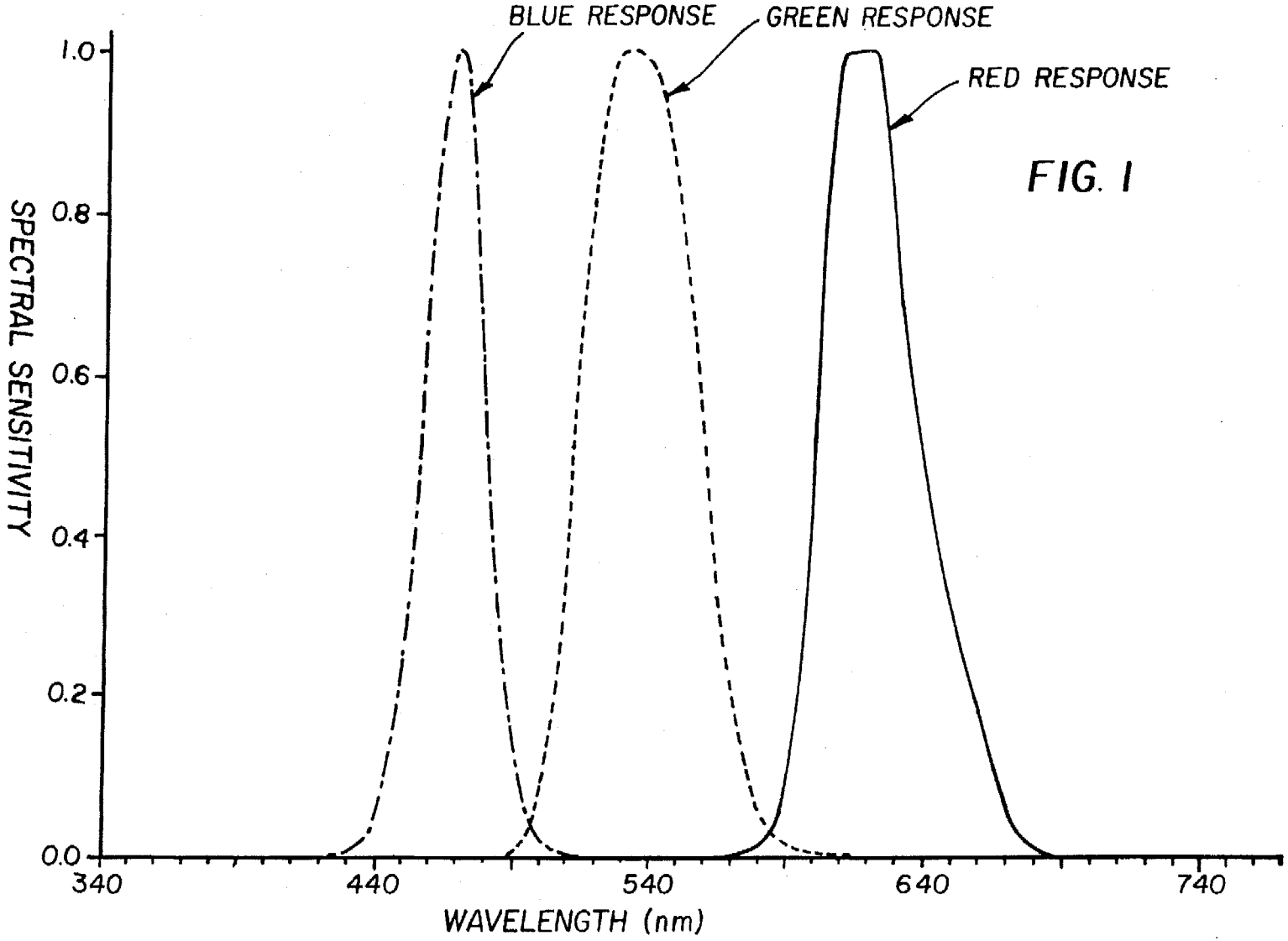
FIG. 1 is an graph of wavelength vs. spectral sensitivity depicting the spectral response of a typical telecine device.

The photographic print film elements of the present invention are color elements and contain dye image-forming units sensitive to each of the three primary regions of the spectrum, i.e. blue (about 400 to 500 nm), green (about 500 to 600 nm), and red (about 600 to 760 nm) sensitive image dye-forming units. Each unit can be comprised of a single emulsion layer or of multiple emulsion layers sensitive to a given region of the spectrum. The layers of the element, including the layers of the image-forming units, can be arranged in various orders as known in the art. In an alternative, less preferred, format, the emulsions sensitive to each of the three primary regions of the spectrum can be disposed as a single segmented layer.

A typical multicolor photographic print element comprises a support bearing a yellow dye image-forming unit comprising at least one blue-sensitive silver halide emulsion layer having associated therewith at least one yellow dye-forming coupler, a cyan dye image-forming unit comprised of at least one red-sensitive silver halide emulsion layer having associated therewith at least one cyan dye-forming coupler, and a magenta dye image-forming unit comprising at least one green-sensitive silver halide emulsion layer having associated therewith at least one magenta dye-forming coupler. Each of the cyan, magenta, and yellow image forming units may be comprised of a single light-sensitive layer, a pack of two light-sensitive layers with one being more light sensitive and the other being less light-sensitive, or a pack of three or more light-sensitive layers of varying light-sensitivity. These layers can be combined in any order depending upon the specific features designed in the photographic element. The element can contain additional layers, such as filter layers, interlayers, overcoat layers, subbing layers, antihalation layers, antistatic layers, and the like.

We have found that by designing films with fixed best fit contrast (FBFC) values below the typical lower limitations of optically projectable color print films, but that are correctable in a telecine device, we obtain benefits not available using typical higher contrast color print films.

The FBFC for each of the color records of a print element is determined by finding the log exposure required to attain a fixed density of 1.0 on the individual D-Log E characteristic curves and then finding the densities on the curves that correspond to log exposure changes of −0.40 and +0.65 relative thereto. These log exposure changes are determined to indicate the approximate position of a 90% reflector scene white and a 1% scene black, respectively. The difference in the densities corresponding to these exposures thus relates to the difference in the black and white of a typical scene. The density range is the difference between these two densities. The FBFC is the density range divided by 1.05 (which is the log exposure difference between the white exposure and the black exposure).

Color print film elements designed for projection viewing generally provide FBFC values for each of their color records of about 2.3 or greater, typically about 2.5 to 3.0, to accommodate the large density ranges (e.g., about 2.5 to 3.2) required to provide pleasing images upon projection. The dynamic range (density range a telecine can accommodate) of an average telecine transfer device, however, is about 2.0. Therefore, the relatively high contrast of typical color print film elements results in a print where the density range between black and white is too high for proper electronic scanning.

In constructing films according to the invention, the required parameters can be achieved by various techniques, examples of which are described below. These techniques are preferably applied to each color record of a silver halide photographic element so that all color records will meet the requirements of the present invention. For example, the reduced contrast position exhibited in films according to the invention may be accomplished by any combination of formulations changes such as reductions in laydowns of silver or image coupler, blend ratio changes of high and low speed emulsions, increased laydowns of image modifying chemistry such as development inhibitor releasing (DIR) or development inhibitor anchimeric releasing (DIAR) couplers, and blend ratio changes of more-active and less-active image couplers. All of these film design tools are well known in the art.

Improved reproduction of shadows is attained with print films with reduced FBFC levels. This is observed in images printed on reduced contrast films and is a factor for reduced-contrast red, green, and blue records. Shadows in print film-to-video transfers of high contrast scenes (500:1) were observed to have more detail when printed on and transferred from film samples with reduced FBFC values compared to images printed on and transferred from typical higher contrast color print films. This is due to how the electronic signal processing of the telecine transfer device adjusts the contrast of images printed on film samples with reduced FBFC values compared to images printed on higher contrast color print films.

Additionally, some characteristics of color print films that are optimized to improve the quality of projected images also improve the quality of the video images obtained using a telecine transfer device, and it is desirable to incorporate such characteristics into the color print films of the invention. These characteristics include, e.g., high color saturation, accurate color hue, high Modulation Transfer Function (MTF), and low granularity.

Higher color saturation and more accurate color hues can be achieved as a result of the particular method employed in formulating a film with reduced FBFC levels. One method employed to reduce the contrast is to reduce the silver levels. Where fixed levels of image modifying couplers such as DIR and DIAR couplers are employed, this would raise the fraction of image modifying coupler to silver ratio, which leads to greater color saturation. Alternatively, increased levels of DIR and/or DIAR image modifying couplers can also be used to reduce the contrast, and these chemicals are well known to increase the color saturation of the resulting film. This is a factor for reduced contrast red, green, and blue records. Particular increases in blue, red, and yellow saturation, and improved accuracy in magenta hue reproduction have been achieved in film-to-video transfers of images printed on film samples with reduced FBFC values.

Higher sharpness is possible as a result of formulating a film with reduced FBFC levels. Reduced image coupler laydowns yield thinner films, which in turn exhibit higher MTF values compared to thicker films. Reduced silver halide laydowns reduces the light scatter within the film, which also increases the MTF values. Finally, increased levels of DIR and/or DIAR image modifying couplers can also be used to achieve higher MTF values. This is a factor for reduced contrast red, green, and blue records.

Lower granularity results by formulating a film with reduced FBFC levels. Reduced densities have been shown to produce reduced granularity levels (*The Theory of the Photographic Process,* 4th ed.; T. H. James Ed.; Macmillan Publishing Co., New York, N.Y., 1977; Ch 21, p 625, eq 21.101). It follows that reduced contrast produces reduced densities. This is a factor for reduced contrast red, green, and blue records.

In addition to improved film performance in print film-to-video transfers, the film samples with reduced FBFC values generally have lower image coupler and silver laydowns compared to conventional contrast color films. This leads to reduced manufacturing costs, which is advantageous.

Figure 2:
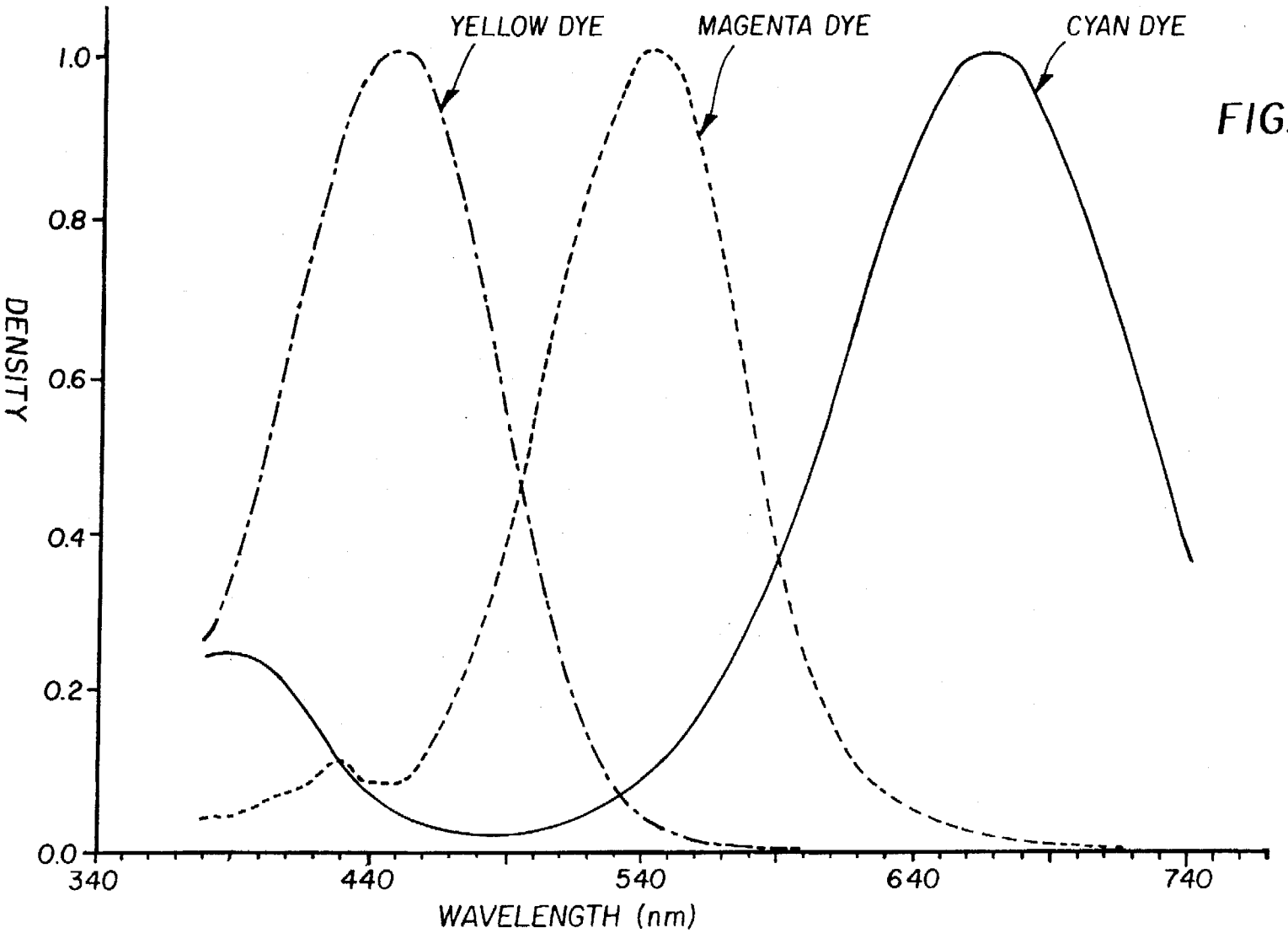
FIG. 2 is a graph of wavelength vs. density depicting the Status-A spectral characteristics of the imaging dyes formed in a typical print film.

In the photographic art, color print film densities are usually measured in the Status-A metric. This metric is a standard spectral response with which the red, green and blue densities of the print film are measured. One drawback of this metric is that it is not an adequate predictor of the performance of a specific film as scanned by an electronic scanning device. The Status-A metric has been used historically to measure photographic materials which are intended to be viewed by a human observer, thus the response was designed to track visual perception. If the peaks of the Status-A response and the electronic scanning device are not similar, then the contrast "as seen by" the scanning device will not be properly reflected by the Status-A measurement. The spectral response of a typical telecine device, e.g., is show in FIG. 1, while the Status-A spectral characteristics of the imaging dyes formed in a typical print film are shown in FIG. 2.

As previously discussed, the Status-A component contrasts of print films intended for projection viewing need to be designed in order to provide pleasing projected images. Where the peak spectral responses of the individual channels of a telecine device do not match with the peak Status-A spectral characteristics of the image dyes formed in a print film as shown in FIGS. 1 and 2, however, the telecine device may not monitor the associated color print dyes equally, which may result in an individual channel signal with greatly reduced modulation of the changes in dye density relative to other channel signals in comparison to the Status-A component response. Such lower modulation signals must be individually amplified to produce a consistent set of red, green and blue tone scales. Such electronic amplification, however, will generally increase the quantity of noise in the signal.

In accordance with an additional advantage of the invention, the Status-A component contrasts of the individual layers of the print film material may be independently adjusted with out needing to enable a pleasing projected image, such that upon transfer with a telecine device which has a spectral response which does not perfectly match the spectral characteristics of the print film imaging dyes they provide telecine signals which have relatively matched characteristics without individual amplification being required. If an individual channel does not have to be independently amplified to attain parity with other channels, then the quantity of noise increase due to electronic amplification is reduced. This results in improved noise characteristics, which may improve the quality of the video tape images obtainable using a telecine transfer device (or any other electronic image capture device).

The relative red, green and blue channel contrasts for a transfer image can be measured in terms of the signals obtained from an electronic scanning device. In accordance with a preferred embodiment of the invention, the print film red, green and blue component contrasts are independently adjusted such that upon making a telecine transfer from a print image the transfer signal ratios for both the red to green and red to blue contrasts in the electronic scanning device densities are from 0.96 to 1.06, most preferably about 1.00, prior to any independent channel signal amplification.

The following advantages accordingly may be obtained with the invention. The component contrasts of the individual layers of a print film material can be adjusted such that they produce improved quality of the video tape images obtained using a telecine transfer device (or any other electronic image capture device). The quantity of noise increase due to electronic amplification may be reduced by selective contrast manipulation. The invention can result in better color saturation and improved color reproduction since there may be less cross contamination between the signals obtained from the electronic scanning of the color print film. In this invention, potential large changes in color correction can be made by altering the contrast appropriately.

In the following discussion of suitable materials for use in the emulsions and elements that can be used in conjunction with the invention, reference will be made to *Research Disclosure,* September 1994, Item 36544, available as described above, which will be identified hereafter by the term "*Research Disclosure.*" The contents of the *Research Disclosure,* including the patents and publications referenced therein, are incorporated herein by reference, and the Sections hereafter referred to are Sections of the *Research Disclosure,* Item 36544.

The silver halide emulsions employed in the elements of this invention will be negative-working emulsions. Suitable silver halide emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing conditions can be found in Sections XI–XX.

It is also contemplated that the materials and processes described in an article titled "Typical and Preferred Color Paper, Color Negative, and Color Reversal Photographic Elements and Processing," published in *Research Disclosure,* February 1995, Item 37038 also may be advantageously used with elements of the invention. It is further specifically contemplated that the print elements of the invention may comprise antihalation and antistatic layers and associated compositions as set forth in copending, commonly assigned U.S. Ser. No. 08/572,904 of Barber et al. and Ser. No. 08/577,757 of Sniadoch et al., both filed Dec. 22, 1995, and 60/006179 of Tingler et al. filed Nov. 2, 1995, the disclosures of which are incorporated by reference herein.

Photographic light-sensitive print elements of the invention may utilize silver halide emulsion image forming layers wherein chloride, bromide and/or iodide are present alone or as mixtures or combinations of at least two halides. The combinations significantly influence the performance characteristics of the silver halide emulsion. Print elements are typically distinguished from camera negative elements by the use of high chloride (e.g., greater than 50 mole % chloride) silver halide emulsions containing no or only a minor amount of bromide (typically 10 to 40 mole %), which are also typically substantially free of iodide. As explained in Atwell, U.S. Pat. No. 4,269,927, silver halide with a high chloride content possesses a number of highly advantageous characteristics. For example, high chloride silver halides are more soluble than high bromide silver halide, thereby permitting development to be achieved in shorter times. Furthermore, the release of chloride into the developing solution has less restraining action on development compared to bromide and iodide and this allows developing solutions to be utilized in a manner that reduces the amount of waste developing solution. Since print films are intended to be exposed by a controlled light source, the imaging speed gain which would be associated with high bromide emulsions and/or iodide incorporation offers little benefit for such print films.

Photographic print elements are also distinguished from camera negative elements in that print elements typically comprise only fine silver halide emulsions comprising grains having an average equivalent circular diameter (ECD) of less than about 1 micron, where the ECD of a grain is the diameter of a circle having the area equal to the projected area of a grain. The ECDs of silver halide emulsion grains are usually less than 0.60 micron in red and green sensitized layers and less than 0.90 micron in blue sensitized layers of a color photographic print element. Such fine grain emulsions used in print elements generally have an aspect ratio of less than 1.3, where the aspect ratio is the ratio of a grain's ECD to its thickness, although higher aspect ratio grains may also be used. Such grains may take any regular shapes, such as cubic, octahedral or cubo-octahedral (i.e., tetradecahedral) grains, or the grains can take other shapes attributable to ripening, twinning, screw dislocations, etc. Typically, print element emulsions grains are bounded primarily by {100} crystal faces, since {100} grain faces are exceptionally stable. Specific examples of high chloride emulsions used for preparing photographic prints are provided in U.S. Pat. Nos. 4,865,962; 5,252,454; and 5,252,456, the disclosures of which are here incorporated by reference.

Couplers that may be used in the elements of the invention can be defined as being 4-equivalent or 2-equivalent depending on the number of atoms of $Ag^+$ required to form one molecule of dye. A 4-equivalent coupler can generally be converted into a 2-equivalent coupler by replacing a hydrogen at the coupling site with a different coupling-off group. Coupling-off groups are well known in the art. Such groups can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. Representative classes of such coupling-off groups include, for example, chloro, alkoxy, aryloxy, heterooxy, sulfonyloxy, acyloxy, acyl, heterocyclyl, sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169; 3,227,551; 3,432,521; 3,476,563; 3,617,291; 3,880,661; 4,052,212 and 4,134,766; and in U.K. Patents and published Application Nos. 1,466,728; 1,531,927; 1,533,039; 2,006,755A and 2,017,704A, the disclosures of which are incorporated herein by reference.

Image dye-forming couplers may be included in elements of the invention such as couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 544,322; 556,700; 556,777; 565,096; 570,006; and 574,948.

Couplers that form magenta dyes upon reaction with oxidized color developing agent which can be incorporated in elements of the invention are described in such representative patents and publications as: U.S. Pat. Nos. 2,600,788; 2,369,489; 2,343,703; 2,311,082; 2,908,573; 3,062,653; 3,152,896; 3,519,429 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo [5,1c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent Applications 176,804; 177,765; U.S. Pat. Nos. 4,659,652; 5,066,575; and 5,250,400.

Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

To control the migration of various components coated in a photographic layer, including couplers, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also be further substituted. Alternatively, the molecule can be made immobile by attachment to a polymeric backbone.

It may be useful to use a combination of couplers any of which may contain known ballasts or coupling-off groups such as those described in U.S. Pat. Nos. 4,301,235; 4,853,319 and 4,351,897.

If desired, the photographic elements of the invention can be used in conjunction with an applied magnetic layer as described in *Research Disclosure,* November 1992, Item 34390 published by Kenneth Mason Publications, Ltd., Dudley House, 12 North Street, Emsworth, Hampshire P010 7DQ, ENGLAND.

Photographic elements of the present invention are motion picture print film elements. Such elements typically have a width of up to 100 millimeters (or only up to 70 or 50 millimeters), and a length of at least 30 meters (or optionally at least 100 or 200 meters). In motion picture printing, there are usually three records to record in the image area frame region of a print film, i.e., red, green and blue. The original record to be reproduced is preferably an image composed of sub-records having radiation patterns in different regions of the spectrum. Typically it will be a multicolor record composed of sub-records formed from cyan, magenta and yellow dyes. The principles by which such materials form a color image are described in James, The Theory of the Photographic Process, Chapter 12, Principles and Chemistry of Color Photography, pp 335–372, 1977, Macmillan Publishing Co. New York. Materials in which such images are formed can be exposed to an original scene in a camera, or can be duplicates formed from such camera origination materials, e.g., records formed in color negative intermediate films such as those identified by the tradenames Eastman Color Intermediate Films 2244, 5244 and 7244. Alternatively, the original record may be in the form of electronic image data, which may be used to control a printer apparatus, such as a laser printer, for selective imagewise exposure of a print film in accordance with the invention.

The elements of the present invention may be exposed under normal printing conditions which may be indicated with the film or other manufacturer recommendations, and processed according to standard processing conditions indicated with the film or its packaging. This is advantageous in that the film user need not experiment with various development or print exposing conditions in order to obtain a desired contrast position. The film of the present invention is preferably simply printed and processed according to standard procedures, and the advantages of the film are obtained. Alternative processing techniques, however, can also be used with films according to the invention if desired.

By "indicated" in relation to the film printing and processing conditions, means that some designation is provided on the film or its packaging or associated with one or the other, which allows the user to ascertain the manufacturer's recommended printing and/or film processing conditions. Such a designation can be an actual statement of the recommended printing or processing conditions or reference to a well-known standard method (for example, the Kodak ECP-2B process for motion picture print films). Alternatively, such a designation can be a film identification designation (such as a number or film name) which allows a user to match the film with the manufacturer's recommended printing or processing conditions (such as from a catalogue, brochure or other source).

The following examples illustrate preparation of photographic elements of the present invention, and their beneficial characteristics.

EXAMPLE 1

A multilayer photographic print element in accordance with the invention was prepared by coating the following layers on a gelatin subbed polyethylene terephthlate support with rem-jet carbon black containing backing layer (Element A). Compositions for comparison print elements in accordance with prior art practice are also indicated (Elements B and C):

| | Element A | Element B | Element C |
|---|---|---|---|
| Protective Overcoat Layer: | | | |
| Poly(dimethyl siloxane) 200-CS | 66 | 66 | 66 |
| Poly(methyl methacrylate) beads | 5.3 | 5.3 | 5.3 |
| Gelatin | 976 | 976 | 976 |
| Spreading aids | | | |
| Green Sensitized Layer: | | | |
| AgClBr cubic grain emulsion, 25% Br, 0.15 micron, spectrally sensitized with green dye cpd 1, 0.5273 mmole/Ag mole, and supersensitizer cpd 2, 1.1212 mmole/Ag mole, | 250 | 243 | 312 |
| AgClBr cubic grain emulsion, 25% Br, 0.15 micron, spectrally sensitized with green dye cpd 1, 0.5273 mmole/Ag mole, and supersensitizer cpd 2, 1.1770 mmole/Ag mole, | 24 | 95 | 122 |
| AgClBr cubic grain emulsion, 25% Br, 0.24 micron, spectrally sensitized with green dye cpd 1, 0.4785 mmole/Ag mole, and supersensitizer cpd 2, 1.3902 mmole/Ag mole, | 24 | 32 | 40 |
| Magenta dye forming coupler M-1 | 437 | 560 | 700 |
| Oxidized developer scavenger cpd 3 | 28 | 45 | 56 |
| Soluble green filter dye 1 | 38 | 32 | 40 |
| Soluble green filter dye 2 | 21 | 47 | 59 |
| Gelatin | 1884 | 1570 | 2077 |
| Interlayer: | | | |
| Oxidized developer scavenger cpd 3 | 79 | 79 | 79 |
| Gelatin | 610 | 610 | 610 |
| Spreading aids | | | |
| Red Sensitized Layer: | | | |
| AgClBr cubic grain emulsion, 25% Br, 0.15 micron, spectrally sensitized with red dye cpd 4, 0.1808 mmole/Ag mole, supersensitizer cpd 2, 0.6327 mmole/Ag mole | 231 | 291 | 398 |
| AgClBr cubic grain emulsion, 25% Br, 0.24 micron, spectrally sensitized with red dye cpd 4, 0.1356 mmole/Ag mole, supersensitizer cpd 2, 0.7444 mmole/Ag mole | 20 | 24 | 32 |
| Cyan dye forming coupler (C-1) | 633 | 775 | 969 |
| Oxidized developer scavenger cpd 3 | 11 | 14 | 26 |
| Soluble red filter dye 3 | 81 | 97 | 121 |

-continued

| | Element A | Element B | Element C |
|---|---|---|---|
| Gelatin | 2207 | 2650 | 3453 |
| Interlayer: | | | |
| Oxidized developer scavenger cpd 3 | 79 | 79 | 79 |
| Gelatin | 610 | 610 | 610 |
| Spreading aids | | | |
| Blue Sensitized Layer: | | | |
| AgCl cubic grain emulsion, 0.58 micron, spectrally sensitized with blue dye cpd 7, 0.3336 mmole/Ag mole | 424 | 551 | 672 |
| AgCl cubic grain emulsion, 0.76 micron, spectrally sensitized with blue dye cpd 7, 0.2669 mmole/Ag mole | 141 | 184 | 224 |
| Yellow dye forming coupler (Y-1) | 1238 | 1564 | 1884 |
| Yellow dye cpd 8 | 0 | 18 | 22 |
| Soluble blue filter dye 4 | 44 | 35 | 33 |
| Sequestrant cpd 9 | 323 | 323 | 323 |
| Sequestrant cpd 10 | 36 | 36 | 36 |
| Gelatin | 2314 | 2882 | 3533 |
| Support: | | | |
| Transparent polyethylene terephthalate support with rem-jet carbon black pigmented, nongelatin layer on the back of the film base which provides antihalation and antistatic properties | | | |

Each element also contained bisvinylsulfonylmethane (BVSM) as a gelatin hardener.

The above films were exposed through a 0–3 density 21-step tablet on a Kodak 1B sensitometer with a 3200 K light source, and processed according to the standard Kodak ECP-2B Color Print Development Process as described in the Kodak H-24 Manual, "*Manual for Processing Eastman Motion Picture Films*", Eastman Kodak Company, Rochester, N.Y., the disclosure of which is incorporated by reference herein. Exposures were adjusted so that a middle (e.g., 11th) step achieved a density of 1.0.

The films were then read for Status A densitometry, and the dye densities were graphed vs. log(exposure) to form Red, Green, and Blue D-LogE characteristic curves for each of the Elements. The white point densities (90% reflector white) and black point densities (1% reflector black) of the films are indicated below, along with the FBFC values calculated for the individual records (FBFC as defined herein equals (Density Difference)/1.05).

| | 90% Reflector White | 1% Reflector Black | Density Difference | FBFC |
|---|---|---|---|---|
| Element A | | | | |
| Red | 0.35 | 2.20 | 1.85 | 1.76 |
| Green | 0.36 | 2.29 | 1.93 | 1.84 |
| Blue | 0.36 | 2.10 | 1.74 | 1.66 |
| Element B | | | | |
| Red | 0.31 | 2.79 | 2.48 | 2.36 |
| Green | 0.34 | 2.67 | 2.33 | 2.22 |
| Blue | 0.35 | 2.70 | 2.35 | 2.24 |
| Element C | | | | |
| Red | 0.30 | 3.38 | 3.08 | 2.94 |
| Green | 0.31 | 3.16 | 2.85 | 2.71 |
| Blue | 0.33 | 3.05 | 2.72 | 2.59 |

The film samples were transferred to video tape using a Rank Model IIIC telecine device with a Rank Digi-IV analog-to-digital converter unit. A Pandora Pogel controller unit connected to the Rank telecine provided standard color grading capabilities. A Tektronix 1735 Waveform Monitor and a Tektronix 1725 Vectorscope were used to adjust the luminance and chrominance values in the transfer operation to render a high quality image. The video signal was recorded on a BTS DRC100 D-1 Recorder.

The difference in the white to black densities of Element A of the invention is well within the dynamic range of the telecine device, whereas the Elements B and C of the prior art are not. The decreased density difference in the inventive film between the highlights and the shadows allows the telecine device operator a greater degree of freedom in the manipulation of the image to attain the desired look. The operator can accordingly adjust the contrast of the image as well as the color quality without clipping the blacks or the whites. The highlight detail is increased without blocking in the shadows. Color reproduction will be improved, as the saturation of pastel colors will increase and not seem washed out.

The following structures represent compounds utilized in the above described photographic elements.

green sensitizing dye cpd 1

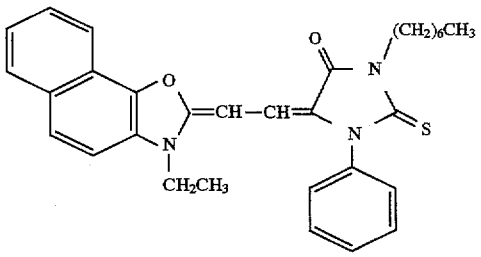

supersensitizer cpd 2

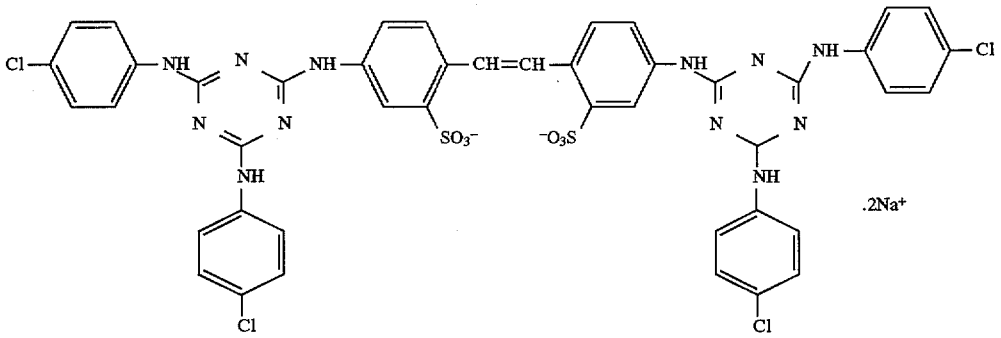

magenta coupler M-1

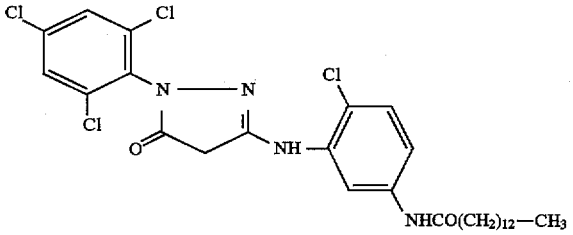

scavenger cpd 3

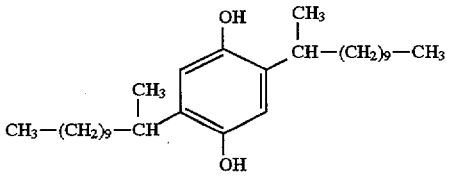

soluble green filter dye #1

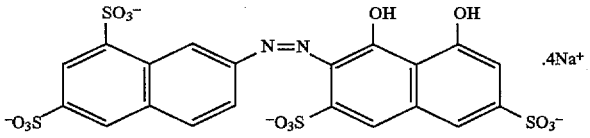

-continued
soluble green filter dye #2
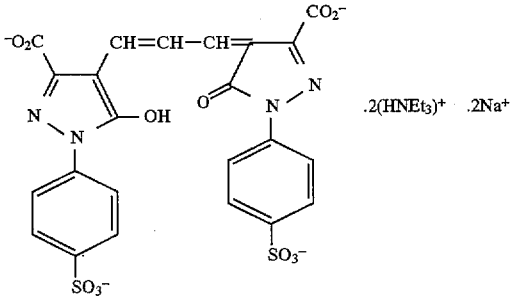
red sensitizing dye dpd 4
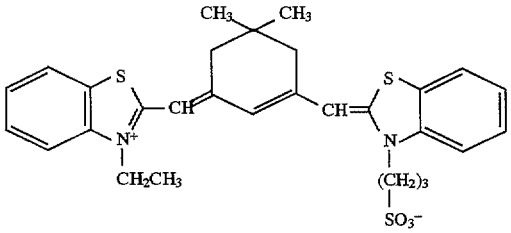
cyan coupler C-1
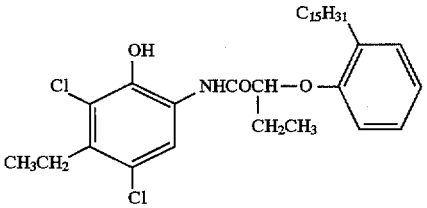
soluble red filter dye #3
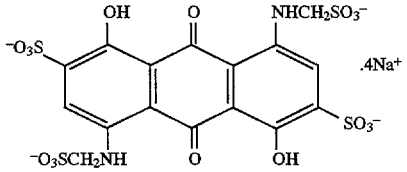
blue sensitizing dye cpd 7
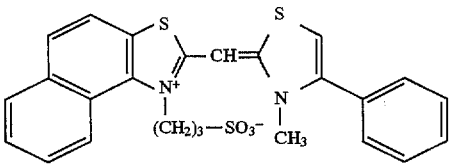
yellow coupler Y-1
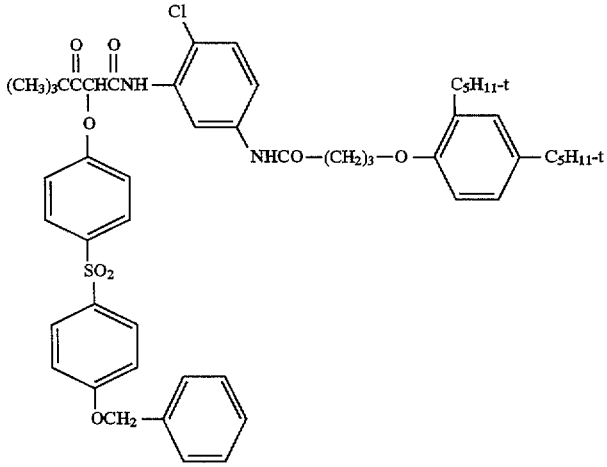

-continued yellow dye cpd 8

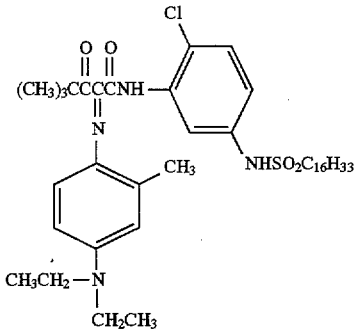

soluble blue filter dye 4

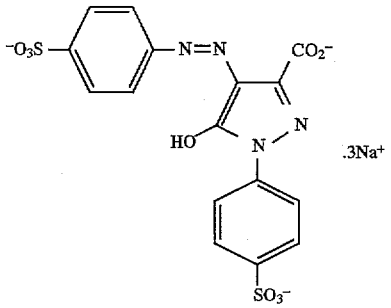

sequestrant cpd 9

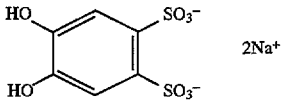

sequestrant cpd 10

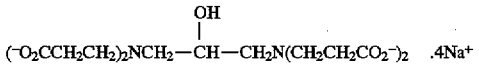

While the invention has been described in detail with particular reference to preferred embodiments, it will be understood that variations and modifications can be effected within the spirit and scope of the invention.

We claim:

1. A negative working silver halide light sensitive photographic print element for use in forming a color positive print image through exposure to a color negative film image and processing to form a developed positive image, the print element comprising a support bearing on one side thereof: a blue color sensitive record comprising at least one blue-sensitive silver halide emulsion yellow-image forming layer, a red color sensitive record comprising at least one red-sensitive silver halide emulsion cyan-image forming layer, and a green color sensitive record comprising at least one green-sensitive silver halide emulsion magenta-image forming layer; wherein at least one of the color records has a fixed best fit contrast less than or equal to 2.2, wherein the fixed best fit contrast for a color record is defined as the slope of a straight line connecting a point B and a point C on the characteristic curve of Status A density versus log Exposure for the color record, where points B and C are located by defining a point A on the characteristic curve at the log Exposure required to attain a density level of 1.0, and points B and C are located on the characteristic curve at exposure values −0.40 log Exposure and +0.65 log Exposure with respect to point A, respectively.

2. A color photographic print element according to claim 1 wherein at least two of the color records has a fixed best fit contrast less than or equal to 2.2.

3. A color photographic print element according to claim 1 wherein each of the red, green and blue color records has a fixed best fit contrast less than or equal to 2.2.

4. A color photographic print element according to claim 1 wherein the red color record has a fixed best fit contrast less than or equal to 2.2.

5. A color photographic print element according to claim 1 wherein the green color record has a fixed best fit contrast less than or equal to 2.2.

6. A color photographic print element according to claim 1 wherein the blue color record has a fixed best fit contrast less than or equal to 2.2.

7. A color photographic print element according to claim 1 wherein the red color record fixed best fit contrast is less than the green color record fixed best fit contrast.

8. A color photographic print element according to claim 1 wherein at least one color record has a fixed best fit contrast less than or equal to 2.0.

9. A color photographic print element according to claim 8 wherein at least two of the color records have fixed best fit contrasts less than or equal to 2.0.

10. A color photographic print element according to claim 9 wherein each of the red, green and blue color records has a fixed best fit contrast less than or equal to 2.0.

11. A color photographic print element according to claim 10 wherein the red color record fixed best fit contrast is less than the green color record fixed best fit contrast.

12. A color photographic print element according to claim 8 wherein the red color record has a fixed best fit contrast less than or equal to 2.0.

13. A color photographic print element according to claim 8 wherein the green color record has a fixed best fit contrast less than or equal to 2.0.

14. A color photographic print element according to claim 8 wherein the blue color record has a fixed best fit contrast less than or equal to 2.0.

15. A color photographic print element according to claim 1, having an effective ISO speed rating of less than about 10.

16. A color photographic print element according to claim 1, wherein the silver halide of each of at least one of the blue-sensitive, red-sensitive, and green-sensitive silver halide emulsion layers comprises silver chloride emulsion grains or silver bromochloride emulsion grains comprising greater than 50 mole % chloride.

17. A color photographic print element according to claim 16, wherein the silver chloride emulsion grains and silver bromochloride emulsion grains of each layer have an average equivalent circular diameter of less than 1 micron and an aspect ratio of less than 1.3.

18. A color photographic print element according to claim 16, wherein each of the red-sensitive and green-sensitive silver halide emulsion layers comprise emulsion grains having an average equivalent circular diameter of less than 0.60 micron, and the blue-sensitive silver halide emulsion layer comprises emulsion grains having an average equivalent circular diameter of less than 0.90 micron.

19. A process of forming a telecine transfer image comprising exposing a print element according to claim 1 to a color negative film image, processing the exposed element to form a developed positive image, and converting the developed positive image into video signals representative of the developed image with a telecine transfer device, wherein the contrast of the video signals representative of the color record of the image having a fixed best fit contrast less than or equal to 2.2 is raised in the telecine transfer device.

20. A process of forming a telecine transfer image comprising exposing a print element according to claim 10 to a color negative film image, processing the exposed element to form a developed positive image, and converting the developed positive image into video signals representative of the developed image with a telecine transfer device, wherein the contrast of the video signals representative of each of the red, green and blue color records of the image is raised in the telecine transfer device.

21. A color photographic print element according to claim 1 wherein each of the red, green and blue color records has a fixed best fit contrast of from 1.66 to 2.2.

22. A process according to claim 19 wherein each of the red, green and blue color records of the print element has a fixed best fit contrast of from 1.66 to 2.2.

23. A process according to claim 20 wherein each of the red, green and blue color records of the print element has a fixed best fit contrast of from 1.66 to 2.0.

* * * * *